United States Patent [19]

Folkins

[11] Patent Number: 4,984,019

[45] Date of Patent: Jan. 8, 1991

[54] ELECTRODE WIRE CLEANING

[75] Inventor: Jeffrey J. Folkins, Rochester, N.Y.

[73] Assignee: Xerox Corporation, Stamford, Conn.

[21] Appl. No.: 485,005

[22] Filed: Feb. 26, 1990

[51] Int. Cl.[5] ..... G03G 21/00

[52] U.S. Cl. ..... 355/215; 355/264

[58] Field of Search ..... 355/215, 264, 261, 265, 355/259, 251, 262, 263

[56] References Cited

U.S. PATENT DOCUMENTS

| | | | |
|---|---|---|---|
| 3,892,481 | 7/1975 | Schaefer et al. | 355/264 |
| 4,073,587 | 2/1978 | Selwyn | 355/215 |
| 4,368,687 | 1/1983 | Kanbe et al. | 355/265 X |
| 4,516,848 | 5/1985 | Moriya | 355/215 |
| 4,568,955 | 2/1986 | Hosoya et al. | 346/153.1 |
| 4,806,992 | 2/1989 | Yasuda et al. | 355/259 |
| 4,868,600 | 9/1989 | Hays et al. | 355/259 |
| 4,876,575 | 10/1989 | Hays | 355/259 |

*Primary Examiner*—A. T. Grimley
*Assistant Examiner*—Sandra L. Hoffman
*Attorney, Agent, or Firm*—H. Fleischer; J. E. Beck; R. Zibelli

[57] ABSTRACT

An apparatus in which an contaminants are removed from an electrode positioned between a donor roller and a photoconductive surface. A magnetic roller is adapted to transport developer material to the donor roller. The electrode is vibrated to remove contaminants therefrom.

21 Claims, 2 Drawing Sheets

ELECTRODE WIRE CLEANING

Figure 1:
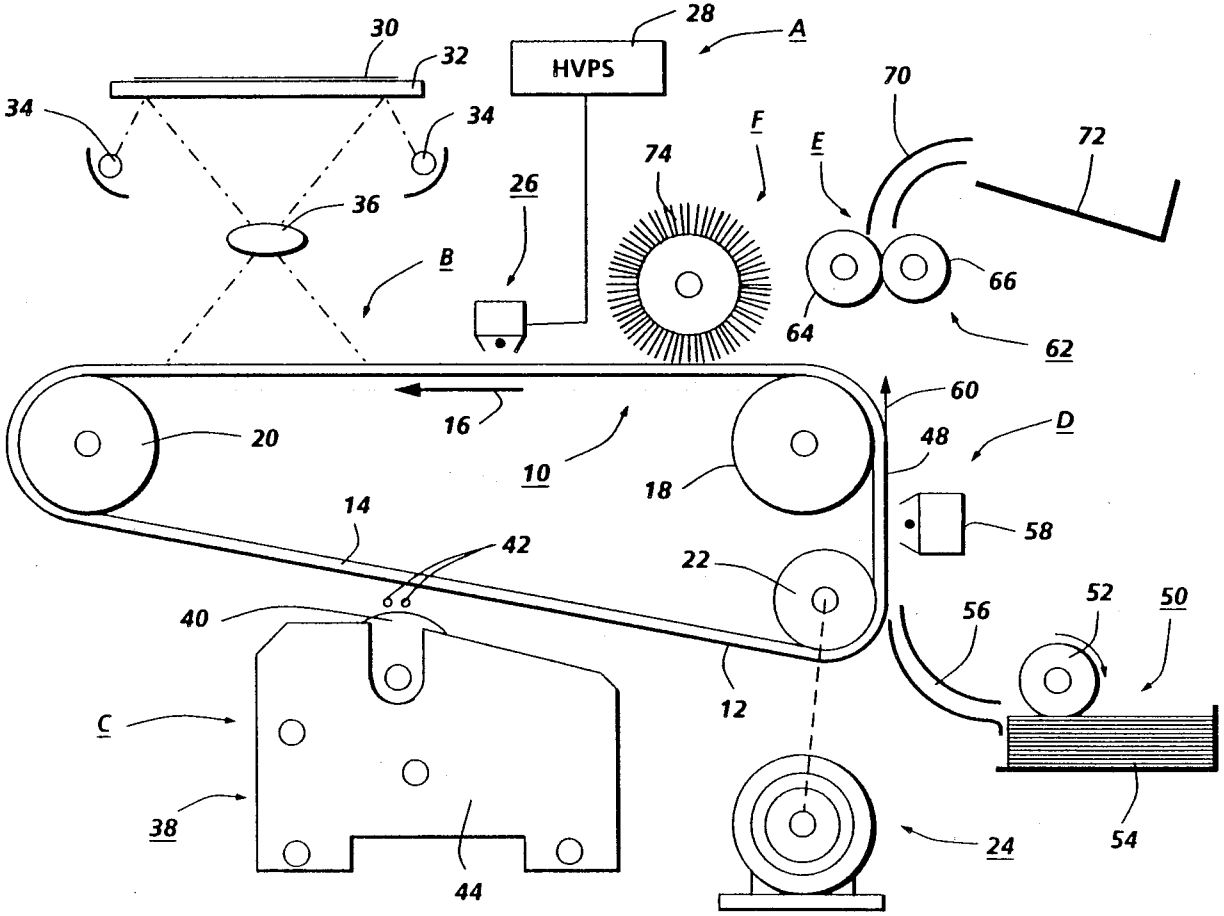

This invention relates generally to an electrophotographic printing machine, and more particularly concerns cleaning electrode wires interposed between a photoconductive surface and a donor roller of a developer unit used to develop a latent image recorded on the photoconductive surface.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer material into contact therewith. Two component and single component developer materials are commonly used. A typical two component developer material comprises magnetic carrier granules having toner particles adhering triboelectrically thereto. A single component developer material typically comprises toner particles. Toner particles are attracted to the latent image forming a toner powder image on the photoconductive surface. The toner powder image is subsequently transferred to a copy sheet. Finally, the toner powder image is heated to permanently fuse it to the copy sheet in image configuration.

Single component development systems use a donor roll for transporting charged toner to the development nip defined by the donor roll and photoconductive member. The toner is developed on the latent image recorded on the photoconductive member by a combination of mechanical and/or electrical forces. Scavengeless development and jumping development are two types of single component development. A scavengeless development system uses a donor roll with a plurality of electrode wires closely spaced therefrom in the development zone. An AC voltage is applied to the wires forming a toner cloud in the development zone. The electrostatic fields generated by the latent image attract toner from the toner cloud to develop the latent image. In jumping development, an AC voltage is applied to the donor roller detaching toner from the donor roll and projecting the toner toward the photoconductive member so that the electrostatic fields generated by the latent image attract the toner to develop the latent image. Single component development systems appear to offer advantages in low cost and design simplicity. However, the achievement of high reliability and easy manufacturability of the system may present a problem. Two component development systems have been used extensively in many different types of printing machines. A two component development system usually employs a magnetic brush developer roller for transporting carrier having toner adhering triboelectrically thereto. The electrostatic fields generated by the latent image attract the toner from the carrier so as to develop the latent image. In high speed commercial printing machines, a two component development system may have lower operating costs than a single component development system. Clearly, two component development systems and single component development systems each have their own advantages. Accordingly, it is desirable to combine these systems to form a hybrid development system having the desirable features of each system. For example, at the 2nd International Congress on Advances in Non-impact Printing held in Washington, D.C. on Nov. 4–8, 1984, sponsored by the Society for Photographic Scientists and Engineers, Toshiba described a development system using a donor roll and a magnetic roller. The donor roll and magnetic roller were electrically biased. The magnetic roller transported a two component developer material to the nip defined by the donor roll and magnetic roller. Toner is attracted to the donor roll from the magnetic roll. The roll is rotated synchronously with the photoconductive drum with the gap therebetween being about 0.20 millimeters. The large difference in potential between the donor roll and latent image recorded on the photoconductive drum causes the toner to jump across the gap from the donor roll to the latent image so as to develop the latent image.

Fiber, bead and toner agglomerate contamination and entrapment on the electrode wires in a scavengeless development system is a significant problem. In order to achieve the reliability that will be required for future printing machines, it is necessary to have a virtually failure free development system. Testing has shown that a large number of streak deletions are caused by contamination of the electrode wires. The severity of this problem is dependent upon many factors such as the number of electrode wires, developed mass, test target type, bead carryout performance, etc.. It is thus clear that it is necessary to reduce and free trapped contaminants on the electrode wires in order to reduce streaks and to achieve the required high reliability. Various approaches have been devised to clean electrode wires. The following disclosures appear to be relevant:

U.S. Pat. No. 4,073,587, Patentee: Selwyn, Issued: Feb. 14, 1978.

U.S. Pat. No. 4,516,848, Patentee: Moriya, Issued: May 14, 1985.

U.S. Pat. No. 4,568,955, Patentee: Hosoya et al., Issued: Feb. 14, 1986.

U.S. Pat. No. 4,868,600, Patentee: Hays et al., Issued: Sept. 19, 1989.

U.S. Pat. No. 4,876,575, Patentee: Hays, Issued: Oct. 24, 1989.

The relevant portions of the foregoing disclosures may be briefly summarized as follows:

U.S. Pat. No. 4,073,587 describes a corotron wire used to charge a photoconductive surface. The corotron wire is vibrated to prevent the accumulation of contaminants thereon. The corotron wire is vibrated by having a movable pick pluck the wire.

U.S. Pat. No. 4,516,848 discloses a charging wire for charging a drum in an electrostatic copying machine. A tongue piece is mounted on a piezoelectric element. A DC signal is applied to the piezoelectric element to flex the tongue and position it in contact with or closely adjacent to the wire. A high frequency signal is superimposed onto the DC signal to flex and vibrate the the tongue piece against the wire to prevent the adhesion of toner powders to the wire.

U.S. Pat. No. 4,568,955 describes a plurality of insulated electrodes located on the surface of a developer roller. The electrodes are connected to an AC and a DC source which generates an alternating electric field between electrodes to cause oscillations of the developer material between the electrodes.

U.S. Pat. No. 4,868,600 discloses a scavengeless development system having electrode wires positioned adjacent a donor roller transporting toner. An AC electric field is applied to the electrode wires to detach the toner from the donor roller forming a toner powder cloud in the development zone.

U.S. Pat. No. 4,876,575 also describes a scavengeless development system having electrode wires positioned adjacent a donor roller transporting toner. An AC electric field is applied to the electrode wires to detach the toner from the donor roller forming a toner powder cloud in the development zone. The frequency of the AC field is between 4 KHZ and 10 KHZ.

In accordance with one aspect of the present invention, there is provided an apparatus for removing contaminants from an electrode member positioned in the space between a surface adapted to have a latent image recorded thereon and a donor member. The apparatus includes means for vibrating the electrode member to remove contaminants therefrom. Means are provided for advancing developer material to the donor member. The advancing means is non-operative in response to the vibrating means being energized.

Pursuant to another aspect of the present invention, there is provided an electrophotographic printing machine of the type in which an electrostatic latent image recorded on a photoconductive member is developed to form a visible image thereof. The improvement includes a housing defining a chamber storing a supply of developer material comprising at least carrier and toner. A donor member is spaced from the photoconductive member and adapted to transport toner to a region opposed from the photoconductive member. An electrode member is positioned in the space between the photoconductive member and the donor member. Means are provided for vibrating the electrode member to remove contaminants therefrom. A transport member, located in the chamber of said housing, is adapted to advance developer material from the chamber of the housing to the donor member.

Figure 2:
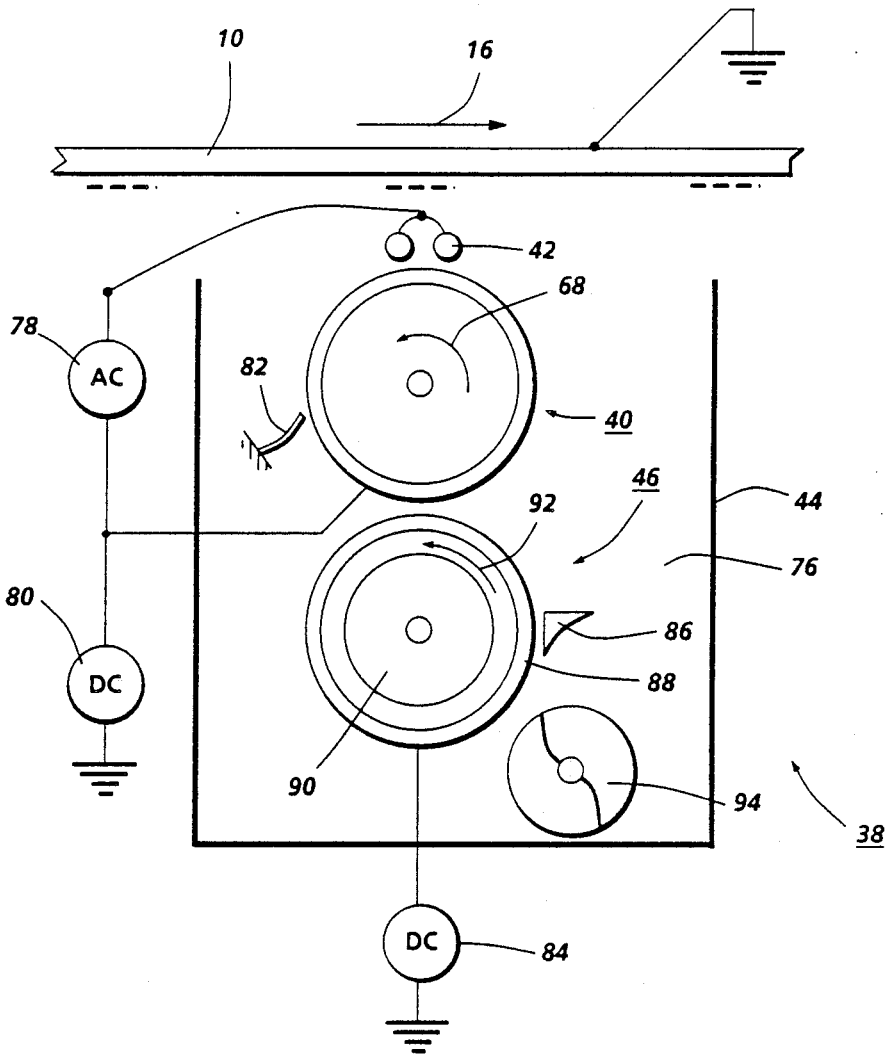

Other features of the present invention will become apparent as the following description proceeds and upon reference to the drawings, in which:

FIG. 1 is a schematic elevational view of an illustrative electrophotographic printing machine incorporating a development apparatus having the features of the present invention therein; and FIG. 2 is a schematic elevational view showing cleaning of the electrode wires of the development apparatus used in the FIG. 1 printing machine.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Referring initially to FIG. 1, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a development system, indicated generally by the reference numeral 38, develops the latent image recorded on the photoconductive surface. Preferably, development system 38 includes donor roller 40 and electrode wires 42. During development of the latent image, electrode wires 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. When the development system is non-operative, donor roller 40 does not develop the latent image recorded on photoconductive surface 12 and electrode wires 42 may be cleaned to remove contaminants adhering thereto. Donor roll 40 is mounted, at least partially, in the chamber of developer housing 44. The chamber in developer housing 44 stores a supply of developer material. The developer material is a two component developer material of at least carrier granules having toner particles adhering triboelectrically thereto. A magnetic roller disposed interiorly of the chamber of housing 44 conveys the developer material to the donor roller. The magnetic roller is electrically biased relative to the donor roller so that the toner particles are attracted from the magnetic roller to the donor roller. The development apparatus and cleaning of the electrode wires will be discussed hereinafter, in greater detail, with reference to FIG. 2.

With continued reference to FIG. 1, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 60 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Referring now to FIG. 2, there is shown development system 38 in greater detail. As shown thereat, development system 38 includes a housing 44 defining a chamber 76 for storing a supply of developer material therein. Donor roller 40, electrode wires 42 and magnetic roller 46 are mounted in chamber 76 of housing 44. The donor roller can be rotated in either the 'with' or 'against' direction relative to the direction of motion of belt 10. In FIG. 2, donor roller 40 is shown rotating in the direction of arrow 68, i.e. the against direction. Similarly, the magnetic roller can be rotated in either the 'with' or 'against' direction relative to the direction of motion of donor roller 90. In FIG. 2, magnetic roller 46 is shown rotating in the direction of arrow 92 i.e. the against direction. Donor roller 40 is preferably made from anodized aluminum.

Development system 38 also has electrode wires 42 which are disposed in the space between the belt 10 and donor roller 40. A pair of electrode wires are shown extending in a direction substantially parallel to the longitudinal axis of the donor roller. The electrode wires are made from of one or more thin (i.e. 50 to 100$\mu$ diameter) tungsten wires which are closely spaced from donor roller 40. The distance between the wires and the donor roller is approximately 25$\mu$ or the thickness of the toner layer on the donor roll. The wires are self-spaced from the donor roller by the thickness of the toner on the donor roller. To this end the extremities of the wires supported by the tops of end bearing blocks also support the donor roller for rotation. The wire extremities are attached so that they are slightly below a tangent to the surface, including toner layer, of the donor structure. Mounting the wires in such a manner makes them insensitive to roll run out due to their self-spacing.

As illustrated in FIG. 2, an alternating electrical bias is applied to the electrode wires by an AC voltage source 78. In operation, the applied AC establishes an alternating electrostatic field between the wires and the donor roller which is effective in detaching toner from the surface of the donor roller and forming a toner cloud about the wires, the height of the cloud being such as not to be substantially in contact with the belt 10. During operation, the magnitude of the AC voltage is relatively low and is in the order of 200 to 600 volts peak at a frequency ranging from about 3 kHz to about 10 kHz. A DC bias supply 80 which applies approximately 300 volts to donor roller 40 establishes an electrostatic field between photoconductive surface 12 of belt 10 and donor roller 40 for attracting the detached toner particles from the cloud surrounding the wires to the latent image recorded on the photoconductive surface. During cleaning of electrode wires 42, donor roller 40 is non-operative. This is achieved by adjusting DC bias supply 80 and/or DC bias supply 84 so that the potential between donor roller 40 and magnetic roller 46 prevents the attraction of toner particles from magnetic roller 46 to donor roller 40. At a spacing ranging from about 10$\mu$ to about 40$\mu$ between the electrode wires and donor roller, an applied voltage of 200 to 600 volts produces a relatively large electrostatic field without risk of air breakdown. The use of a dielectric coating on either the electrode wires or donor roller helps to prevent shorting of the applied AC voltage. A cleaning blade 82 strips all of the toner from donor roller 40 after development so that magnetic roller 46 meters fresh toner to a clean donor roller. Magnetic roller 46 meters a constant quantity of toner having a substantially constant charge on to donor roller 40. This insures that the donor roller provides a constant amount of toner having a substantially constant charge in the development gap. In lieu of using a cleaning blade, the combination of donor roller spacing, i.e. spacing between the donor roller and the magnetic roller, the compressed pile height of the developer material on the magnetic roller, and the magnetic properties of the magnetic roller in conjunction with the use of a conductive, magnetic developer material achieves the deposition of a constant quantity of toner having a substantially constant charge on the donor roller. During operation, DC bias supply 84 applies approximately 100 volts to magnetic roller 46 relative to donor roller 40 to establish an electrostatic field between magnetic roller 46 and donor roller 40 which causes toner particles to be attracted from the magnetic roller to the donor roller. When the development system is in the non-operative mode and electrode wires 42 are being cleaned, DC electrical bias 80 and/or DC electrical bias 84 is adjusted so that the toner particles remain adhering to the carrier granules on magnetic roller 46 and are not attracted to donor roller 40. Metering blade 86 is positioned closely adjacent to magnetic roller 46 to maintain the compressed pile height of the developer material on magnetic roller 46 at the desired level. Magnetic roller 46 includes a non-magnetic tubular member 88 made preferably from aluminum and having the exterior circumferential surface thereof roughened. An elongated magnet 90 is positioned interiorly of and spaced from the tubular member. The magnet is mounted stationarily. The tubular member rotates in the direction of arrow 92 to advance the developer material adhering thereto into the nip defined by donor roller 40 and magnetic roller 46. Toner particles are attracted from the carrier granules on the magnetic roller to the donor roller.

With continued reference to FIG. 2, augers, indicated generally by the reference numeral 94, are located in chamber 76 of housing 44. Augers 94 are mounted rotatably in chamber 76 to mix and transport developer material. The augers have blades extending spirally outwardly from a shaft. The blades are designed to advance the developer material in the axial direction substantially parallel to the longitudinal axis of the shaft.

As successive electrostatic latent images are developed, the toner particles within the developer material are depleted. A toner dispenser (not shown) stores a supply of toner particles. The toner dispenser is in communication with chamber 76 of housing 44. As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized. In this way, a substantially constant amount of toner particles are in the chamber of the developer housing with the toner particles having a constant charge. The developer material in the chamber of the developer housing is magnetic and may be electrically conductive. By way of example, the carrier granules include a ferromagnetic core having a thin layer of magnetite overcoated with a non-continuous layer of resinous material. The toner particles are made from a resinous material, such as a vinyl polymer, mixed with a coloring material, such as chromogen black. The developer material comprise from about 95% to about 99% by weight of carrier and from 5% to about 1% by weight of toner. However, one skilled in the art will recognize that any suitable developer material having at least carrier granules and toner particles may be used.

Preferably, when electrode wires 42 are cleaned, toner particles are not attracted to donor roller 40. Cleaning blade 82 removes the residual toner adhering to donor roller 40 and substantially no toner is advanced to electrode wires 42. Electrode wires 42 are vibrated in order to remove contaminants therefrom. Vibration is induced in electrode wires 42 by applying an AC bias having a suitable frequency thereon. During cleaning, AC voltage source 78 applies an AC electrical bias on electrode wires 42 ranging from about 1 HZ to about 100 HZ. Preferably, the electrical biasing frequency is about 10 HZ. This frequency will cause electrode wires 42 to physically oscillate allowing fibers, beads or other agglomerates trapped by wires 42 to be released and carried away by the rotating donor roll. Alternatively, AC voltage source 78 can apply a nominal AC electrical bias selected from the frequency range of between from about 3,000 HZ to about 10,000 HZ with this frequency being modulated on and off at a frequency selected from between about 1 HZ and 100 HZ with the preferred modulating frequency being 10 HZ. In either case, contaminants trapped by the electrode wires are released and removed therefrom by the rotating donor roller. The cleaning mode is operational when the latent image is remote from the development zone, or when the printing machine is being cycled in or out of operation.

One skilled in the art will appreciate that while it is preferred to clean the electrode wires by vibrating them when the development system is non-operative, under certain circumstances, in the interdocument zones, it may be desirable to clean the electrode wires by vibrating them when the development system is operative.

In recapitulation, it is evident that the development apparatus of the present invention includes electrode wires positioned closely adjacent the exterior surface of a donor roller and being in the gap between the donor roller and the photoconductive member. The electrode wires are cleaned by vibrating them to remove contaminants therefrom. Vibration is induced in the electrode wires by applying an AC voltage thereon having a suitable frequency. The frequency of the AC voltage applied on the electrode wires during cleaning may range from about 1 HZ to about 100 HZ and is preferably 10 HZ. Alternatively, a nominal frequency selected from between about 3,000 HZ to about 10,000 HZ modulated on and off at a frequency of selected from between about 1 HZ and 100 HZ may be used.

It is, therefore, apparent that there has been provided in accordance with the present invention, a development system in which the electrode wires are cleaned that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for removing contaminants from an electrode member positioned in a space between a surface adapted to have a latent image recorded thereon and a donor member, including:

means for vibrating said electrode member to remove contaminants therefrom; and means for advancing developer material to said donor member, said advancing means being inoperative in response to said vibrating means being energized.

2. An apparatus for removing contaminants from an electrode member positioned in a space between a surface adapted to have a latent image recorded thereon and a donor member, including:

means for vibrating said electrode member to remove contaminants therefrom, said vibrating means includes means for electrically biasing said electrode member; and means for advancing developer material to said donor member, said advancing means being inoperative in response to said vibrating means being energized.

3. An apparatus according to claim 2, wherein said electrical biasing means applies an AC electrical bias to said electrode member.

4. An apparatus according to claim 3, wherein said electrical biasing means applies an AC electrical bias to said electrode member having a frequency ranging from about 1 HZ to about 100 HZ.

5. An apparatus according to claim 4, wherein said electrical biasing means applies an AC electrical bias to said electrode member having a frequency of about 10 HZ.

6. An apparatus according to claim 3, wherein said electrical biasing means applies an AC electrical bias to said electrode member having a frequency between 3,000 HZ and 10,000 HZ and modulating this frequency on and off at a frequency selected from between 1 HZ and 100 HZ.

7. An apparatus according to claim 3, wherein the developer material being transported by said advancing means to said donor member is magnetic.

8. An apparatus according to claim 7, wherein said advancing means includes:

a non-magnetic tubular member mounted rotatably so as to advance developer material from the chamber of said housing to said donor member; and an elongated magnetic member disposed interiorly of said tubular member for attracting developer material to the surface of said tubular member.

9. An apparatus according to claim 8, wherein the donor member includes a roll.

10. An apparatus according to claim 9, wherein the electrode member includes a plurality of small diameter wires.

11. An electrophotographic printing machine of the type in which an electrostatic latent image recorded on a photoconductive member is developed to form a visible image thereof, wherein the improvement includes:

a housing defining a chamber storing a supply of developer material comprising at least carrier and toner;

a donor member spaced from the photoconductive member and being adapted to transport toner to a region opposed from the photoconductive member;

an electrode member positioned in a space between the photoconductive member and said donor member;

means for vibrating said electrode member to remove contaminants therefrom; and a transport member, located in the chamber of said housing, adapted to advance developer material from the chamber of said housing to said donor member.

12. An electrophotographic printing machine of the type in which an electrostatic latent image recorded on a photoconductive member is developed to form a visible image thereof, wherein the improvement includes:

a housing defining a chamber storing a supply of developer material comprising at least carrier and toner;

a donor member spaced from the photoconductive member and being adapted to transport toner to a region opposed from the photoconductive member;

an electrode member positioned in the space between the photoconductive member and said donor member;

means for vibrating said electrode member to remove contaminants therefrom said vibrating means is inoperative in response to said transport member advancing developer material to said donor member; and a transport member, located in the chamber of said housing, adapted to advance developer material from the chamber of said housing to said donor member.

13. A printing machine according to claim 12, wherein said vibrating means includes means for electrically biasing said electrode member.

14. A printing machine according to claim 13, wherein said electrical biasing means applies an AC electrical bias to said electrode member.

15. A printing machine according to claim 14, wherein said electrical biasing means applies an AC electrical bias to said electrode member having a frequency ranging from about 1 HZ to about 100 HZ.

16. A printing machine according to claim 15, wherein said electrical biasing means applies an AC electrical bias to said electrode member having a frequency of about 10 HZ.

17. A printing machine according to claim 13, wherein said electrical biasing means applies an AC electrical bias to said electrode member having a frequency selected from between 3,000 HZ to 10,000 HZ and modulating this frequency on and off at a frequency selected from between 1 HZ to 100 HZ.

18. A printing machine according to claim 13, wherein the developer material being transported by said advancing means to said donor member is magnetic.

19. A printing machine according to claim 18, wherein said advancing means includes:

a non-magnetic tubular member mounted rotatably so as to advance developer material from the chamber of said housing to said donor member; and an elongated magnetic member disposed interiorly of said tubular member for attracting developer material to the surface of said tubular member.

20. A printing machine according to claim 19, wherein said donor member includes a roll.

21. A printing machine according to claim 20, wherein said electrode member includes a plurality of small diameter wires.

* * * * *